United States Patent [19]

Heidelbach

[11] 3,940,101

[45] Feb. 24, 1976

[54] QUICK-BONDING ADHESIVELY ATTACHABLE SUPPORT PADS FOR PALLETIZING CONTAINERS

[75] Inventor: Charles A. Heidelbach, Geneva, Ill.

[73] Assignee: Fiat-Allis Construction Machinery, Inc., Deerfield, Ill.

[22] Filed: Aug. 2, 1974

[21] Appl. No.: 494,085

[52] U.S. Cl. ..... 248/346; 108/51; 108/56; 229/23 R

[51] Int. Cl.[2] ..... B65D 19/20

[58] Field of Search ..... 108/51, 58, 53, 56; 248/205 A; 229/23 R; 248/346

[56] References Cited

UNITED STATES PATENTS

| | | | |
|---|---|---|---|
| 2,432,295 | 12/1947 | Donahue | 108/58 X |
| 2,493,562 | 1/1950 | Yarman | 108/58 |
| 2,494,730 | 1/1950 | Thursby | 108/55 X |
| 2,738,153 | 3/1956 | Frase | 108/58 |
| 3,029,303 | 4/1962 | Severino | 248/205 A |
| 3,331,496 | 7/1967 | Marsden et al. | 108/51 X |
| 3,434,434 | 3/1969 | Horton, Jr. | 108/51 |
| 3,695,506 | 10/1972 | Cook | 108/51 X |

*Primary Examiner*—Davis T. Moorhead

[57] ABSTRACT

Support pads formed of stacks or rolls of corrugated material have instant-bonding (pressure sensitive) adhesive on one surface thereof to adapt them for instant attachment to the underside of shipping containers, such as corrugated boxes, to provide an integral palletized container construction.

3 Claims, 10 Drawing Figures

QUICK-BONDING ADHESIVELY ATTACHABLE SUPPORT PADS FOR PALLETIZING CONTAINERS

BACKGROUND OF THE INVENTION

1. Field of Use

This invention relates generally to support pads adhesively attachable to the underside of shipping containers to serve to palletize the container and facilitate handling of the containers as by means of fork-lift trucks.

2. Description of the Prior Art

Shipping containers used in industry to package and transport various products, component parts and the like frequently take the form of relatively large boxes formed of corrugated material or cardboard which are sometimes supplied in knocked-down form and assembled as required. The bottom side of such containers may be relatively weak because of the inherent nature of the box material or because the bottom side actually comprises flaps which are folded together and secured by suitable means. In any event, handling and stacking of such containers by means of fork-lift trucks is facilitated if the box is disposed on some sort of pallet. Conventional reuseable pallets made of wood or other materials are commercially available. However, such pallets must be stored before and after use and this requires considerable space. In addition, such pallets are relatively costly and deposit arrangements are sometimes required to insure their return by the customer to the supplier. Cheaper disposable pallets are available which comprise a flat sheet of corrugated material to the bottom surface of which discrete rolls of corrugated material are attached during manufacture by conventional air-drying gluing processes. Again, however, such pallets are relatively large and require an undue amount of valuable storage space prior to use. Furthermore, during the manufacture of such pallets, considerable space is required to enable the glue used to set. Heretofore, strips of wood, such as 2 × 4s, or other materials, have been glued directly to the bottom of previously assembled containers by means of conventional air-drying glues to provide containers having built-in pallets. However, these arrangements still have drawbacks. For example, the wood used is costly and is not ordinarily salvageable or reuseable for pallet purposes. Similarly, made-up containers having built-in pallet means require relatively costly manufacturing techniques and also require more storage space than simple conventional knockdown-type corrugated boxes or containers.

The following patents disclose the state of the art in palletized containers: U.S. Pat. Nos. 3,247,810; 3,331,496; 3,398,703; 3,425,367; 3,464,371; 3,519,190; 3,605,651; 3,695,506; and 3,697,029.

SUMMARY OF THE PRESENT INVENTION

In accordance with the present invention there are provided support pads in the form of legs or runners which have a coating or layer of quick-drying adhesive, such as pressure sensitive adhesive, applied to one surface of the pad; such coating or layer of adhesive being protected until ready for use by means of a removable protective sheet of material such as waxed or treated paper. The pads are adapted for instant attachment or bonding to the underside of a shipping container to palletize the container. The pads are formed of layers or stacks or rolls of corrugated material, such as corrugated cardboard, and are furnished with the aforesaid adhesive already applied to a surface thereof. The pads are applied to the underside of the container in desired positions when the container is being readied for use or shortly after the container is made up, if the container is furnished in knocked-down form. The pads serve to strengthen the underside of the box, serve to space the container from a surface on which it rests thereby facilitating its being lifted by a fork-lift or other means, serve to prevent the container from resting directly on the surface, if such is not desirable, and also serve as a cushioning means for the container.

Several embodiments of the invention are disclosed. In one embodiment, each pad takes the form of an elongated runner comprising strips of material, preferably corrugated, secured together in a stack by suitable means such as glue and having a corrugated top strip and a hardboard bottom strip glued to the top and bottom edges of the stack. In a second embodiment, each pad takes the form of an elongated runner comprising strips of material, preferably corrugated, surrounded and secured together by a sheath of material, also preferably corrugated. In a third embodiment, each pad comprises a roll of material, preferably corrugated, and secured to prevent unravelling. In the embodiments, the planes of the strips forming the stacks are perpendicular to the top surface thereof and each pad comprises at least one surface for juxtaposition and connection to the container on which a coating or layer of quick-drying or so-called instant-bonding adhesive, such as pressure sensitive adhesive, is applied during manufacture of the pad. The coating or layer of adhesive is protected until ready for use by a removable sheet of material such as waxed or treated paper. When the pad is ready for attachment the adhesive is activated or exposed by peeling off the protective sheet and the pad is applied to the appropriate surface of the container and pressed thereagainst. Although pads in accordance with the invention are especially useful for application to the underside of a container for the purposes hereinbefore described, one or more pads could be used on the sides of a container to provide for spacing, cushioning or even ventilation between two containers stacked side-by-side in a warehouse or on a truck or train. Other objects and advantages of the invention will hereinafter appear.

DRAWINGS

DESCRIPTION OF PREFERRED EMBODIMENTS

Figure 1:
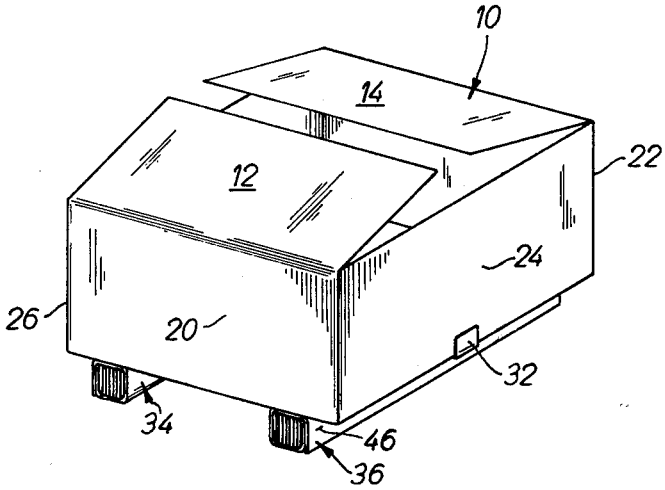
FIG. 1 is an isometric view from the top side of a container having support pads secured thereto by quick-setting adhesive in accordance with the invention.
Figure 2:
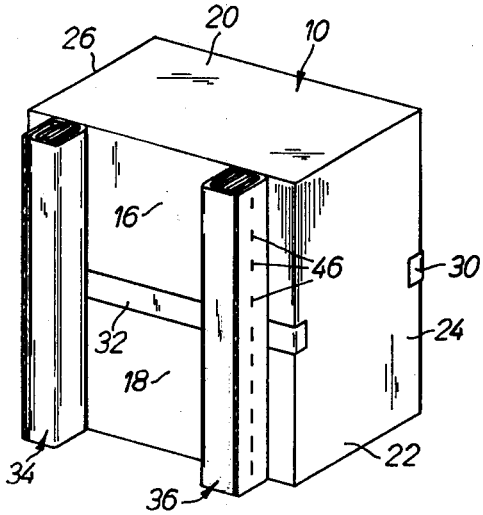
FIG. 2 is an isometric view of the bottom side of the container shown in FIG. 1.

Referring to FIGS. 1 and 2, the numeral 10 designates a shipping container such as is used in industry to package and transport various products, component parts or the like and with which the present invention is advantageously employed. FIG. 1 shows container 10 resting on one side to provide a view of the underside thereof. Container 10, for example, may take the form of a box formed of corrugated material or cardboard which is supplied to the user in the form of a flat knocked-down blank and is assembled when needed. Container 10 comprises a top side comprising two inwardly foldable flaps 12 and 14, a bottom side also comprising two inwardly folded flaps 16 and 18 best seen in FIG. 2, a front side 20, a rear side 22, a front end 24 and a rear end 26. The mating edges of the top flaps 12 and 14 are sealable by a strip of adhesive paper or tape 30, as shown in FIG. 2. The mating edges of the bottom flaps 16 and 18 are also sealed by a strip of adhesive paper or tape 32, as shown in FIGS. 1 and 2.

To facilitate the handling and stacking of container 10 by means, for example of a fork-lift truck or similar apparatus, or to space the container from the surface on which it rests, the bottom side of the container is provided with support pads in the form of elongated legs or runners 34 and 36 which are secured to the bottom side of the container by means of a quick-drying adhesive, such as a pressure sensitive adhesive, in accordance with the present invention.

As FIG. 2 best shows, the runners 34 and 36 are elongated and of rectangular cross section and are disposed in spaced apart relationship on the bottom side of a container 10 so that their longitudinal axes extend transversely to the mating edges of the flaps 16 and 18 on the bottom side of the container. When the elongated legs or runners 34 and 36 are disposed in this manner they serve to strengthen the underside of container 10 as well as provide a means for spacing the underside of the container from the surface on which it rests thereby providing a palletized container easily liftable by a fork-lift truck.

Figure 3:
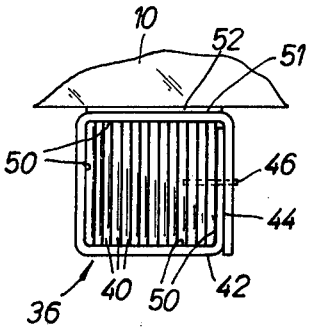
FIG. 3 is an enlarged end view of a support pad shown in FIGS. 1 and 2.
Figure 4:
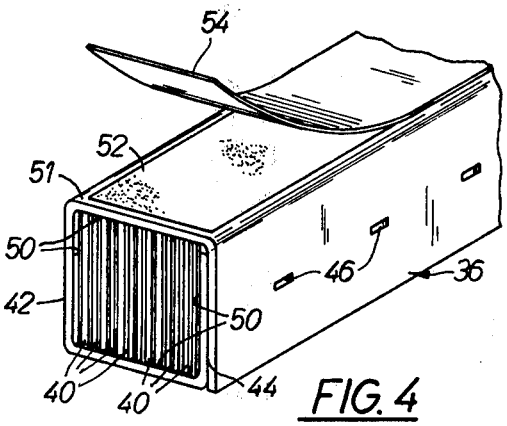
FIG. 4 is an isometric view of a support pad shown in FIGS. 1, 2 and 3.

Since the pads 34 and 36 are identical, only pad 36 is hereafter described in detail. As FIGS. 3 and 4 show, pad, leg or runner 36 comprises a plurality of strips or layers 40 of corrugated material or cardboard which are stacked or arranged alongside one another and which are secured against displacement by an outer sheath or cover 42 of corrugated material which is folded around the stack and secured together as by gluing at 44 or by means of a plurality of staples 46. If desired, the adjacent strips 40 may be glued together during assembly and prior to placement of the sheath 42 therearound. Furthermore, glue may be disposed on the inner sides of sheath 42 as at 50. As FIG. 3 shows, each strip 40 preferably lies in a plane which is transverse (i.e. at right angles) to the bottom surface of container 10 thus enabling a pad 36 to support a greater compressive load.

The upper side 51 of pad, leg or runner 36 is provided during manufacture with a coating or layer 52 of quick-drying or instant bonding adhesive, such as commercially available pressure sensitive adhesive, which is protected until ready for use by means of a removable sheet or layer 54 of paper or film which is treated to prevent it from adhering permanently to layer 52 and which may be peeled away. The layer 52 of adhesive and the removable sheet 54 are applied to the surface 50 of the leg or runner 36 during manufacture of the latter.

After container 10 has been assembled and at least the bottom side thereof has its flaps 16 and 18 folded inwardly and suitably secured or sealed in place as by the tape 32, the legs or runners 34 and 36 are attached to the bottom side of the container. More specifically, the protective sheet 54 is stripped away from the adhesive coating 52 provided on surface 50 of each leg or runner 34 and 36, and the sides or surfaces 50 of the pads 34 and 36 which are coated with adhesive are pressed against the undersurface of container 10. Since quick drying or instant bonding adhesive is employed, each pad 34 and 36 is immediately attached to container 10. Although FIGS. 1 and 2 show only two elongated pads 34 and 36 secured to the underside of container 10, it is apparent that additional pads arranged in a desired manner and with desired spacing could be applied to the underside of the container.

Figure 5:
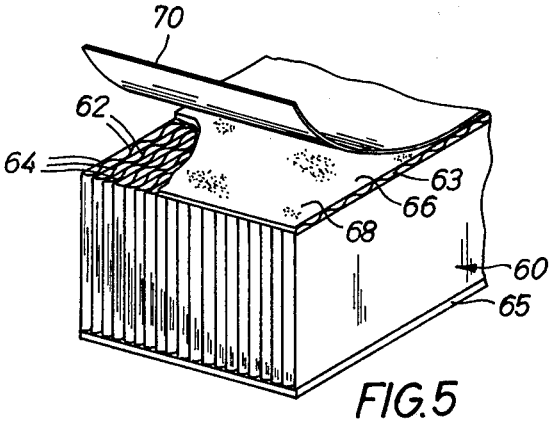
FIG. 5 is an isometric view of another form of support pad.

FIG. 5 is a perspective view of another type of elongated support pad 60 which is similar to pad 36 in that it comprises a plurality of strips or layers 62 of corrugated material or cardboard which are understood to be secured together as at 64 by suitable adhesive, but which, unlike pad 36, is not provided with a folded outer sheath. Instead, pad 60 is provided with a top strip 63 formed of corrugated material which is glued by a suitable adhesive to the top edges of the strips 62. The strips 63 and 65 strengthen and rigidify the entire pad 60 and protect the edges of the strips 62 forming the stack. Furthermore, top strip 63 provides a flat uninterrupted surface for the layer 68 of instant bonding adhesive. The bottom strip 65, being of hardboard, is rugged and strong and capable of withstanding a considerable amount of scuffing and scraping. Like pad 36, the upper surface 66 of top strip 63 of pad 60 is provided with a layer 68 of quick drying or instant bonding adhesive which is protected by a removable sheet 70. Pad 60 is usable in the same manner and for the same purpose as pad 36, as hereinbefore described.

Figure 7:
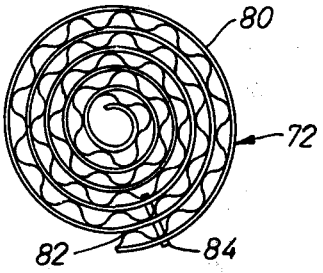
FIG. 7 is a bottom plan view of the support pad shown in FIG. 6.
Figure 6:
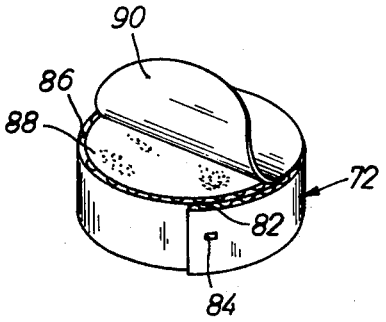
FIG. 6 is an isometric view of a cylindrical type of support pad in accordance with the invention.
Figure 8:
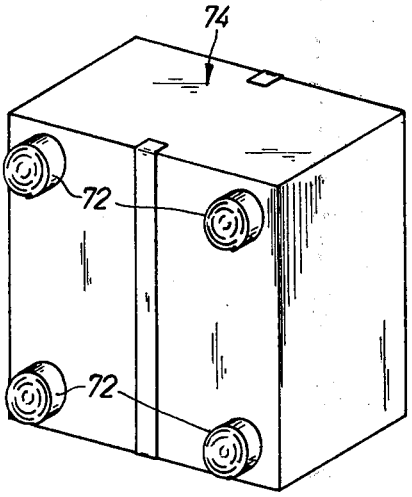
FIG. 8 is an isometric view of the bottom of a container employing cylindrical support pads disposed in accordance with one arrangement.
Figure 9:
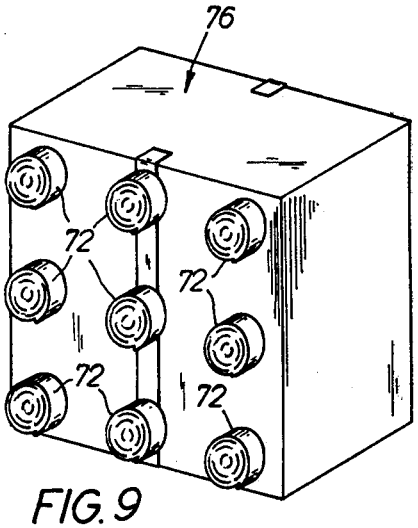
FIG. 9 is a view similar to FIG. 8 but showing the support pads disposed in accordance with another arrangement.

FIGS. 6 and 7 show another type of support pad 72 in accordance with the invention, and FIGS. 8 and 9 show pluralities of support pads 72 affixed to the undersides of containers 74 and 76, respectively, which containers are similar in all respects to container 10 hereinbefore described. Each support pad 72 is generally cylindrical in form and is formed of a wound or rolled strip 80 of corrugated material or cardboard. The outermost end of strip 80 is secured as by gluing at 82 or by a staple 84 to prevent pad 72 from unravelling. One flat end of the cylindrical pad 72 serves as the upper side 86 of the pad and is provided with a coating or layer 88 of quick-drying or instant bonding adhesive, such as the pressure sensitive adhesive hereinbefore described, which is protected until ready for use by means of a removable sheet or layer 90 of paper or film of the type hereinbefore described.

The support pads 72 may be applied to the bottom of a container in any desired arrangement. FIG. 8 shows four pads 72 arranged symmetrically, one near each box corner. FIG. 9 shows nine pads 72 arranged in symmetrical rows of three pads each; the arrangement in FIG. 9 being preferably over that of FIG. 8 if container 76 carries a substantially heavier load.

Figure 10:
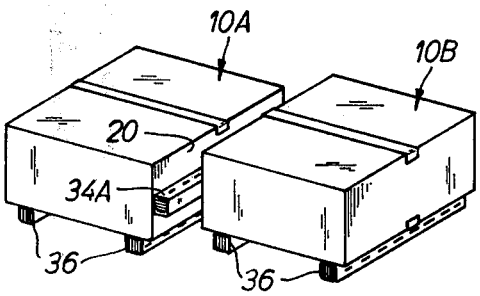
FIG. 10 is an isometric view showing two containers disposed in side-by-side relationship with support pads in accordance with the invention used for palletizing and to perform a spacing function therebetween.

FIG. 10 shows two containers 10A and 10B arranged in side by side relationship and each container has two spaced apart pads such as 36 applied to the underside thereof to space the container from its supporting surface. In addition, container 10A has a support pad 34A in accordance with the invention applied to a lateral side or end 20 thereof to serve as a cushion or spacer for container 10B therealongside.

In an actual embodiment of a support pad 60 of the type shown in FIG. 5 the pad was about 27½ inches long, 4 inches wide and 3 inches high. The support pad 60 comprised about 20 strips or layers 62 of corrugated material, each strip being on the order of 3/16 inch thick and joined to an adjacent strip by conventional air drying adhesive. The bottom strip 65 took the form of hardboard on the order of ⅛ inch thick, and the top strip 63 took the form of corrugated material on the order of ⅛ inch to 3/16 inch thick. Although the pads disclosed herein are preferably formed of strips or layers of corrugated material which are arranged to define spaces therein with the axes of the spaces being disposed normal to the upper side and the lower side of the support pad, as shown in FIGS. 5 and 7, for example, it is apparent that a support pad in accordance with the invention could comprise other honeycomb types of material having spaces with axes orientated in the same manner as the spaces in the corrugated material.

I claim:

1. A rigid load bearing support pad for quick attachment directly to the underside of a shipping container to space the container from a surface on which it rests, said pad having a lower side for disposition toward said surface and an upper side for disposition toward said underside of said container, said pad comprising:

a plurality of elongated strips of corrugated sheet material arranged to provide a stack of adjacent contiguous layers of said sheet material, each of said strips defining at least one of said layers and said adjacent contiguous layers of said sheet material being glued together, each of said layers of said corrugated sheet material having corrugations which are disposed normal to said upper side and said lower side of said support pad;

top and bottom rigid facing strips rigidly secured by gluing at the upper side and at the lower side of said stack, respectively, and transversely disposed with respect to said corrugations;

a coating of instant bonding adhesive disposed on the upper surface of said top facing strip and serving as the sole means to effect attachment of said support pad directly to said underside of said container when pressed thereagainst, and a removable protective sheet overlying said coating.

2. An elongated support pad according to claim 1 wherein said top and bottom rigid facing strips are formed by opposite sides of a rigid sheath of corrugated sheet material which is secured around said stack.

3. An elongated support pad according to claim 1 wherein said bottom rigid facing strip comprises hardboard.

* * * * *